United States Patent [19]

Bell

[11] 4,295,842

[45] Oct. 20, 1981

[54] STRIPPING DEVICE FOR REMOVING WASTE SHEET BOARD

[75] Inventor: Clinton C. Bell, Carmel, Ind.

[73] Assignee: The Ward Machinery Company, Cockeysville, Md.

[21] Appl. No.: 108,803

[22] Filed: Dec. 31, 1979

[51] Int. Cl.[3] ..... B26D 7/18

[52] U.S. Cl. ..... 493/342; 83/161; 493/82; 493/373

[58] Field of Search ..... 93/36 A, 59 ES; 83/161, 83/113, 103; 493/342, 373, 82, 83, 370, 472

[56] References Cited

U.S. PATENT DOCUMENTS

| | | | |
|---|---|---|---|
| 2,778,286 | 1/1957 | Walker | 493/373 |
| 3,270,602 | 9/1966 | Kirby et al. | 93/36 A X |
| 3,371,584 | 3/1968 | Zernov | 493/373 |
| 3,380,327 | 4/1968 | Stemmler | 93/36 A |
| 3,391,589 | 7/1968 | Bishop | 83/103 |
| 3,643,553 | 2/1972 | Morimoto | 93/36 A |
| 3,877,353 | 4/1975 | Smith et al. | 93/36 A |
| 3,899,947 | 8/1975 | Faltin | 93/36 A X |
| 3,956,974 | 5/1976 | Schröter | 93/36 A |
| 4,031,816 | 6/1977 | Matsuo | 93/36 A |

*Primary Examiner*—James F. Coan

*Attorney, Agent, or Firm*—Boyce C. Dent

[57] ABSTRACT

A stripping device for removing waste sheet material from the vicinity of a cutter. In one embodiment, a plurality of pins are mounted to a rotatable drum positioned adjacent a rotary steel cutting die. The die includes knives for cutting a sheet of material into a desired configuration with the waste portion of the sheet remaining wedge on the die. The stripper pins pierce and lift the waste portion of the sheet away from the die. In lieu of a drum, a plurality of hubs mounted to a common shaft may be provided having the stripping pins mounted thereon. In another embodiment, the stripping pins are mounted directly to the rotary cutter. A cam-actuated lever mounted to the rotary cutter is operable to eject the waste sheet portion from the stripping pins.

8 Claims, 5 Drawing Figures

STRIPPING DEVICE FOR REMOVING WASTE SHEET BOARD

BACKGROUND OF THE INVENTION

A variety of devices have been provided for cutting blanks from sheet board and then separating the scrap or waste sheet from the blanks. Typically, steel rule cutting dies are constructed to eject both the finished cut product and the waste material simultaneously at the moment of cutting. Disclosed herein is a steel rule cutting die constructed to wedge the waste material between the knives in the cutting die with the wedged material subsequently removed from the die by a stripper.

Stripping machines are available provided for removing waste material from the cut sheet. For example, in U.S. Pat. No. 3,643,553 issued to Morimoto, there is disclosed a stripping machine wherein a plurality of rotatably mounted pins are forced into the waste portion to be cut from the cardboard sheet. Similar machines are disclosed in the following U.S. Pat. Nos. 3,391,589 issued to Bishop; 3,877,353 issued to Smith et al.; and 4,031,816 issued to Matsuo.

SUMMARY OF THE INVENTION

One embodiment of the present invention is a stripping device for removing waste sheet wedged in a sheet cutting die rotatable about an axis comprising a frame, a stripping pin holder rotatably mounted on the frame and having an axis of rotation extending in the same direction and parallel to the axis of the cutting die, a plurality of stripping pins mounted to the holder and extending therefrom, the pins have length and are positionable adjacent the cutting die as the holder rotates to extend into the cutting die piercing the waste sheet and removing the waste sheet from the cutting die upon continued rotation of the cutting die and the holder, and means operably engaged with the holder to rotate the holder in synchronization with the cutting die.

Another embodiment of the present invention is the combination of a rotary die cutter including a first drum and a second drum with parallel axes of rotation, the first drum having a sheet cutting die means mounted thereon movable past the second drum, the die means including cutting edges separating the die means into a product-forming portion and a waste sheet-forming portion and operable to cut a sheet of material passing between the first drum and the second drum, a stripping holder rotatably mounted adjacent the first drum and having a parallel axis of rotation, the stripping holder having a plurality of stripping pins mounted thereto and extending therefrom into the waste sheet-forming portion of the die to pierce and remove sheet material located therein, drive means engaged with the first drum, second drum and stripping holder and operable to rotate the first drum in a direction opposite the second drum and the stripping holder to move the stripping pins into and out of the waste sheet-forming portion of the die means.

Yet another embodiment of the present invention is a rotary cutter with stripper comprising a first rotatably mounted drum with an outer circumferentially extending sheet-supporting surface, a second rotatably mounted drum with an axis of rotation parallel to the first drum and including a knife edge to cut a sheet of material moving between the first drum and second drum into a product portion and a waste portion, drive means operable engaged with the first drum and the second drum and operable to rotate the second drum in a direction opposite the rotation of the first drum, a stripper pin mounted to the second drum and extending externally therefrom into the waste portion as the pin is moved past the first drum and sheet passing therebetween, second means operable to remove the waste portion from the pin.

Further, an embodiment of the present invention is an apparatus comprising a cylindrical-shaped holder and a plurality of stripping pin means mounted thereto and operable to remove waste sheet material from a rotary cutting die mounted adjacent to the holder.

It is an object of the present invention to provide a stripping device for use with a rotary die cutter to achieve complete stripping of all waste material to be ejected.

A further object of the present invention is to provide a new and improved stripping device.

Yet another object of the present invention is to provide a stripping device for use with a stitch-glue lap cross-cut holder provided on printer slotters and flexographic folder-gluers.

Related objects and advantages of the present invention will be apparent from the following description.

DESCRIPTION OF THE PREFERRED EMBODIMENTS

Figure 1:
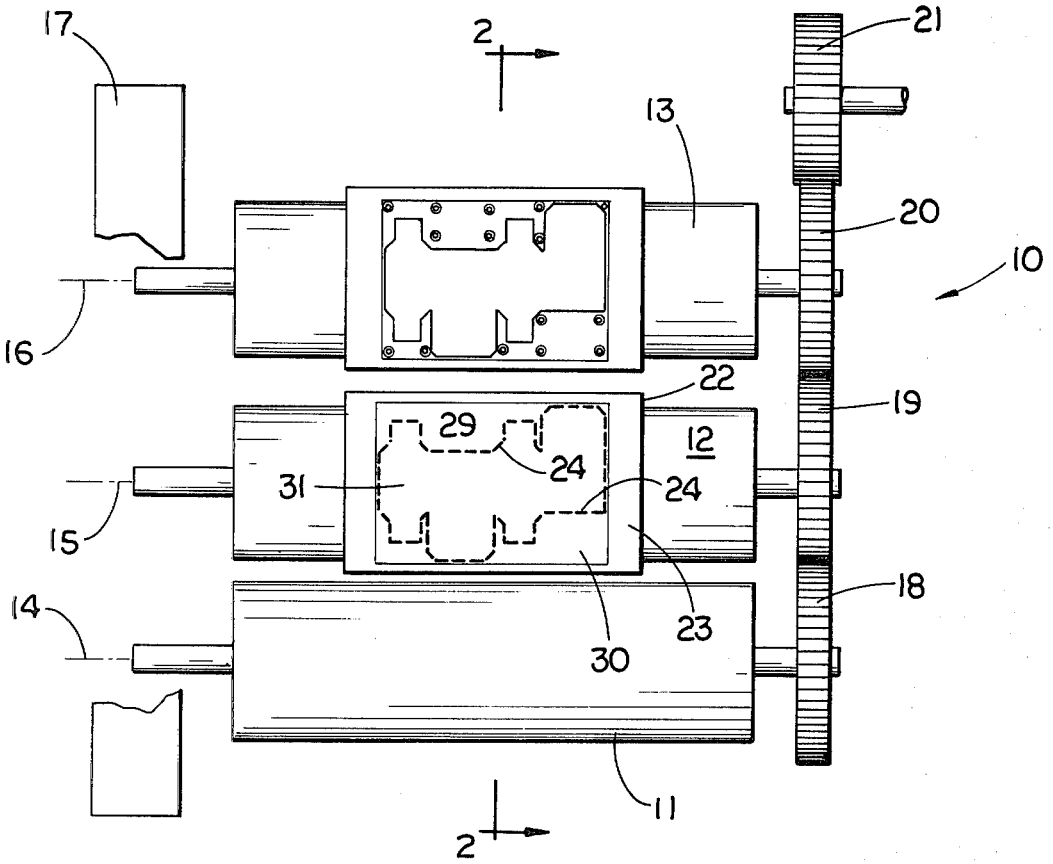
FIG. 1 is a fragmentary plan view of a rotary steel rule cutting die with stripper constructed in accordance with the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
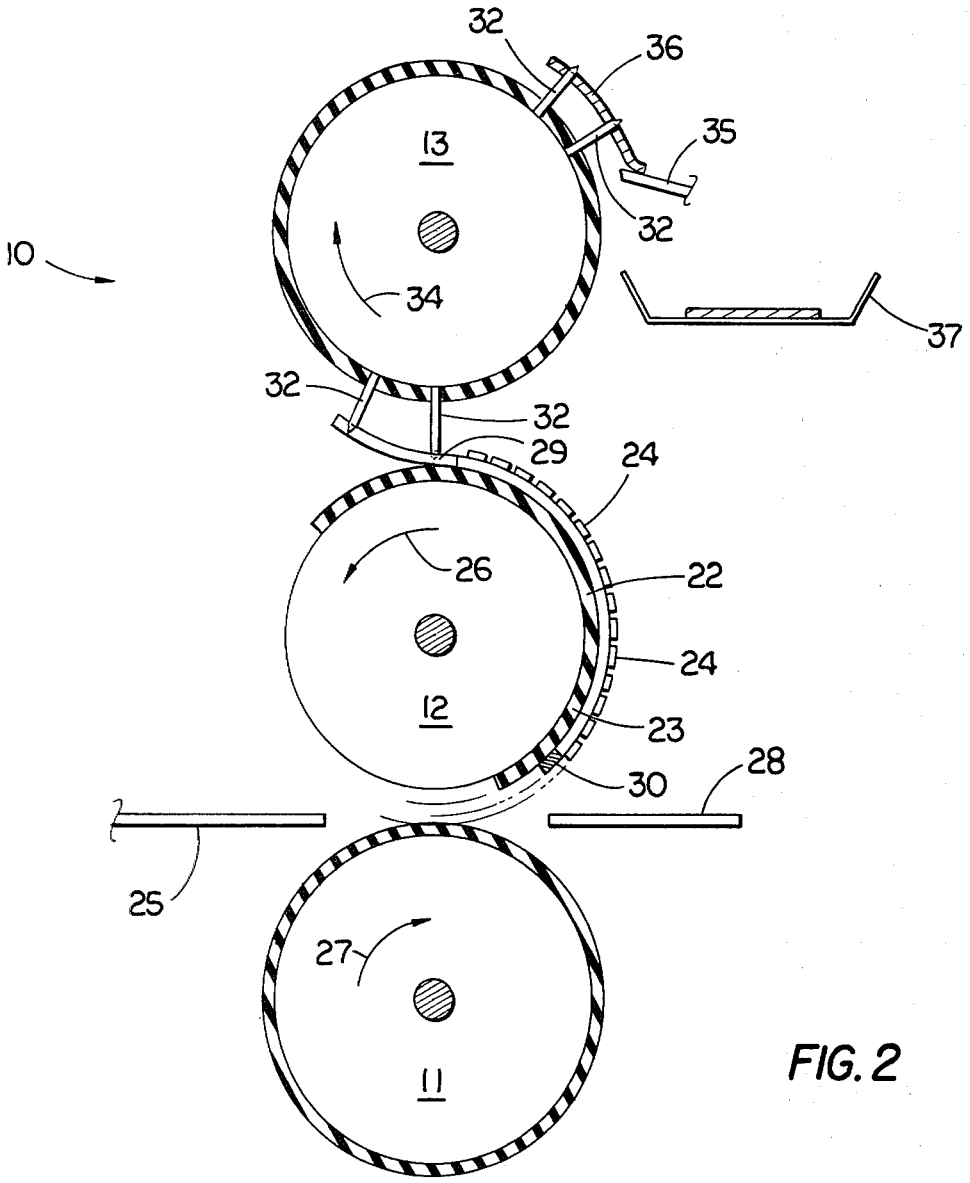
FIG. 2 is an enlarged cross-sectional view taken along line 2—2 and viewed in the direction of the arrows only showing the middle and top drums rotated to depict the removal of waste material by the stripping pins.

Referring more particularly to FIGS. 1 and 2, there is shown an apparatus 10 including a rotary steel rule cutting die constructed in such a manner as to eject only the finished product and to wedge the waste material between the steel rule cutting knives and to then subsequently eject the waste material by means of a stripper. Apparatus 10 includes three cylindrical drums 11, 12 and 13 having respectively parallel but spaced apart axes of rotation 14, 15 and 16. Each cylindrical drum has a drive shaft bearingly received and supported at its opposite ends by a suitable frame 17. Meshing sprocket gears 18–20 are respectively provided at one end of each drive shaft for drums 11 through 13 and are driven by a suitable drive means 21 of conventional construction. Thus, each cylindrical drum rotates in synchronization and at the same angular speed.

Drum 12 includes a rotary steel rule cutting die 22 mounted on its circumference and extending at least partially therearound. Die 22 includes a base plate 23 affixed to the drum with a plurality of upstanding cutting knives 24 mounted to base plate 23 and extending radially outward therefrom. The cutting knives are arranged in a pattern providing for the final cut sheet. The bottom drum 11 is spaced apart from drum 12 a sufficient distance to allow an uncut sheet 25 to be conveyed between drums 11 and 12 with the drums being sufficiently close to enable knives 24 to cut sheet 25 as the drums are rotated in opposite directions as shown in FIG. 2 by arrows 26 and 27. Once the incoming sheet 25 has been cut by knives 24, the cut sheet will pass completely between and from drums 11 and 12 with the final cut product represented by sheet 28 in FIG. 2 and with the remaining portion or waste material of sheet 25 remaining upon die 22 as represented by waste portions 29 and 30. Cutting knives 24 are arranged to define and form two separate portions of the sheet of material, namely the desired final configuration 31 (FIG. 1) and the waste portions 29 and 30 wedged between knives 24 and temporarily stuck on the die.

The waste material to be ejected from the die is removed from its wedged position between the steel rule cutting knives by a plurality of stripping pins mounted to the third drum or stripping pin holder 13. Stripping pins 32 are attached to a suitable base in turn attached to cylindrical drum 13. The pins 32 and mounting base along with drum 13 are combined to form a stripping die rotated in the direction of arrow 34 opposite to the rotational direction of drum 12. Stripping pins 32 are attached to drum 13 at the desired location across the width and around the circumference of the drum to mate with the various waste material configurations formed by the steel rule cutting knives 24. As drum 13 is rotated, stripping pins 32 will come into contact with waste portion 29 eventually piercing waste portion 29 and then applying a forward and lifting pressure to the waste material removing the waste material from die 22 and carrying the waste material to a disposal location.

The length of stripping pins 32 is particularly critical to the satisfactory operation of the stripping device. More specifically, the radial distance from axis 16 to the outermost extremities of stripping pins 32 must exceed the radial distance from axis 15 to the steel rule cutting knives. Since both drums 12 and 13 are rotating at the same angular speed, the greater radial distance of pins 32 provides a greater surface speed of the stripping pins as compared to the surface speed of the steel rule cutting knives thereby permitting the tips of the stripping pins to exert pressure against waste material 29 to be ejected from its wedged position between the steel rule cutting knives. The pressure of the tips of the stripping pins 32 against the waste material to be ejected, creates a lifting action at the moment of separation as the stripping device and the rotary steel rule cutting die continues to rotate through 360°.

The waste material clings to the stripping pins as the stripping device or holder 13 rotates. The waste material is removed from the stripping pins by means of stripping plates 35 placed laterally across the width of the stripping device in close proximity to the rows of stripping pins. The stripping plates are supported through 360° of rotation of the drum 13 by a base which extends around the circumference of drum 13. Plates 35 strip the waste material 36 to be ejected from drum 13 and deposit such material in a disposal conveyance 37.

Figure 3:
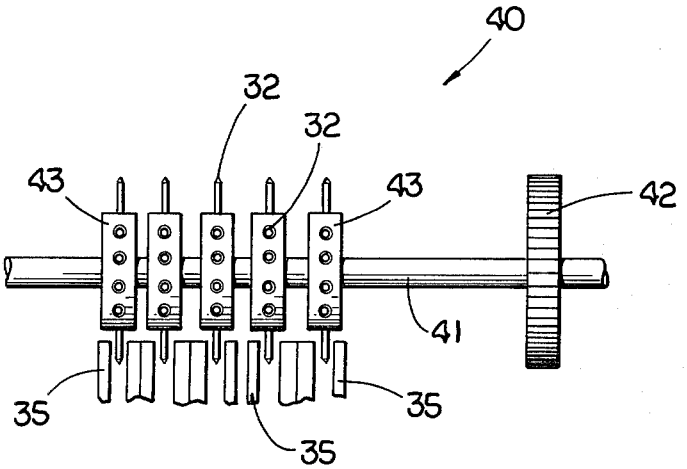
FIG. 3 is a fragmentary side view of an alternate embodiment of the stripping device.

An alternate embodiment of the stripping device is shown in FIG. 3. Stripping device 40 includes a shaft 41 rotatably mounted in a manner identical to the mounting of the drum 13 previously described with one end of shaft 41 having a sprocket gear 42 mounted thereon in meshing engagement with sprocket gear 19 attached to drum 12. Thus, shaft 41 has an axis of rotation parallel to axis 15. The stripping device represented by drum 13 is merely removed and replace with stripping device 40 and operates in the manner identical to that previously described for the embodiment shown in FIG. 1.

Laterally movable hubs 43 are mounted to shaft 41 with stripping pins 32 in turn mounted to hubs 43 in the desired locations to remove the waste sheet material from die 23. The stripping pins may be inserted around the periphery of hubs 43 to mate with the cut-out configurations described by the steel rule cutting knives and the rotary steel rule cutting die. Such stripping pins may be of varying lengths, permitting a variation in surface speed of their tips during the rotation of the stripping device. A plurality of stripping plates 35 identical to that described and shown in the embodiment depicted in FIG. 2 is provided adjacent to the rotating stripping pins 32 upon hubs 43 to position plates 35 between the movable hubs. The stripping plates force the waste sheet material to be ejected from the stripping pins and deposit such material in a disposal conveyance identical to conveyance 37. Hubs 43 may be mounted to shaft 41 in a number of conventional constructions.

Figure 4:
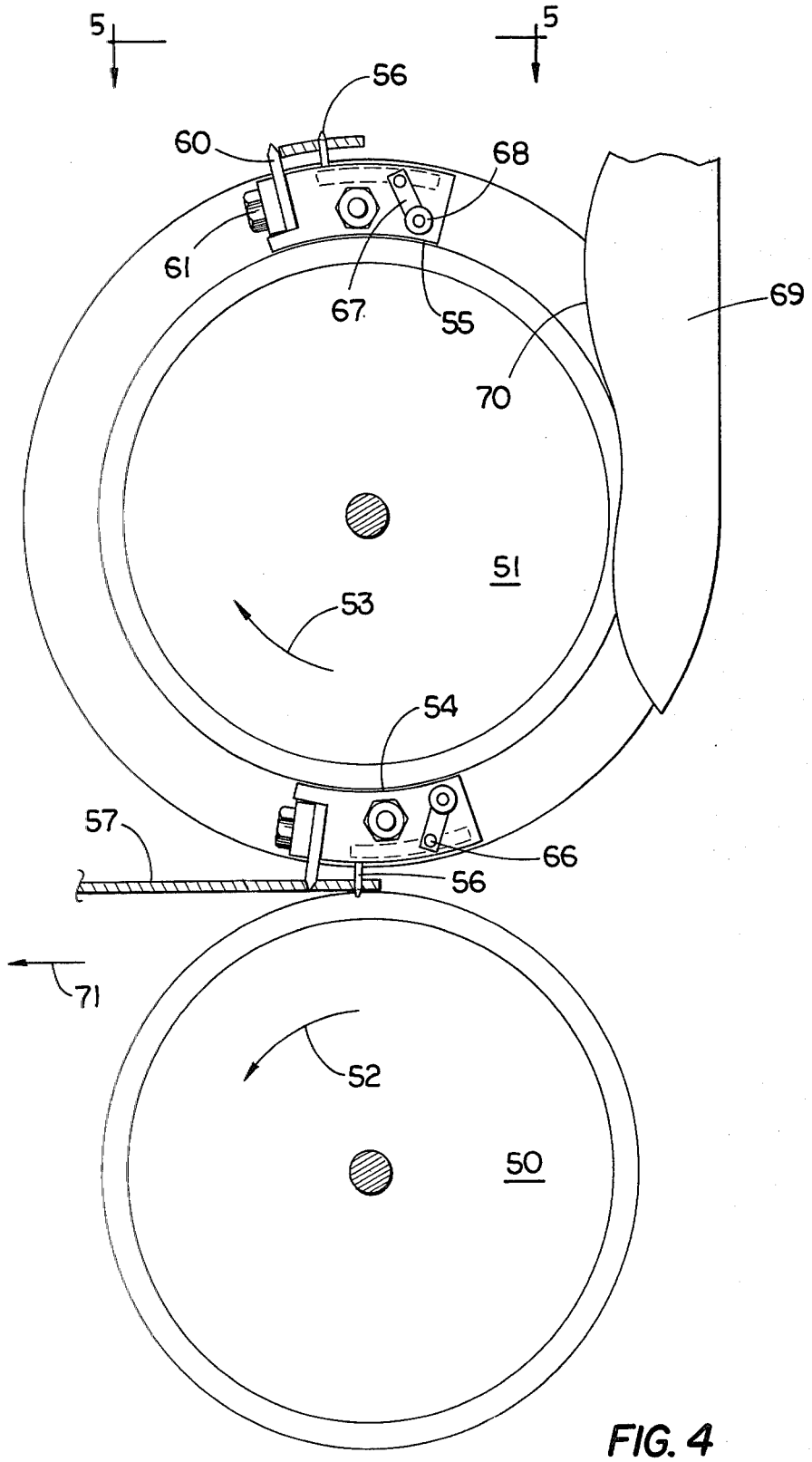
FIG. 4 is a cross-sectional view of a stitch-glue lap head with a cross-cut holder including a stripper.

A modification to the stripping device as it pertains to a cross-cut, stitch-glue lap holder is shown in FIG. 4 for controlling and ejecting the waste sheet material which occurs at printer slotters and flexographic folder-gluers. Drums 50 and 51 are rotatably mounted and bearingly supported by a suitable frame having parallel axes of rotation with drum 50 rotating in the direction of arrow 52 and drum 51 rotating in the direction of arrow 53. A left-hand cross-cut holder 54 and a right-hand cross-cut holder 55 are attached to a conventional stitch-glue lap head formed by drum 51. A plurality of stripping pins 56 are attached to holders 54 and 55 to penetrate the waste portion of a sheet of material 57 passing between the two drums.

Figure 5:
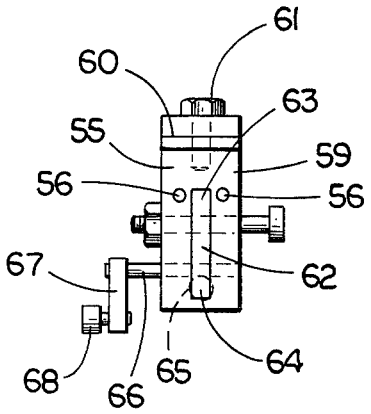
FIG. 5 is a fragmentary top view of the stripping device looking in the direction of arrows 5—5.

Holder 55 will now be described, it being understood that a similar description applies to holder 54. Holder 55 includes a main body or block 59 fixedly attached to drum 51 by conventional fastening devices. A cross-cut knife 60 is attached to block 59 by a conventional fastener 61. Likewise, stripping pins 56 are fixedly secured to block 59 and extend radially outward from drum 51. A spring-biased lever or arm 62 extends between the pair of stripping pins 56 shown in FIG. 5 and includes a pair of ends 63 and 64 with the lever or arm normally being recessed within block 59. A helical spring 65 is seated within a recess within block 59 and is in contact with lever 62 to normally urge end 63 of the lever to a recessed position with the lever being pivotally mounted by fastener 66 in turn having an outwardly extending end fixedly attached to arm 67 having a roller 68 mounted offset from fastener 66. An external member 69 is spaced apart from but positioned by drum 51 and has a cam or control surface 70 positioned to engage roller 68 as the roller is moved past member 69 as drum 51 is rotated. Cam surface 70 defines a path causing roller 68 to pivot along with arm 67 in a clockwise direction, as viewed in FIG. 4 thereby causing end 63 of lever 62 to move outwardly past the tips of stripping pins 56 thereby forcing the waste portion clinging to the stripping pins away from the pins and into a suitable disposal conveyance, not shown, similar to conveyance 37. Thus, the end product of sheet 57 is conveyed away from the drums in a direction of arrow 71 whereas the waste portion continues to move in a direction of arrow 53 clinging to the stripping pins until removed therefrom by the pivoting lever.

The present invention provides control of ejected material to prevent it from interleaving with the finished product. The control of ejected material will prevent contamination of inking systems, provide a safe, clean machine operation and significantly improve productivity. The stripping devices disclosed herein remove the waste material from its wedged position in steel rule cutting dies in a controlled manner at the desired time and location as the device rotates through 360° of travel. Power to rotate the stripping device may be supplied from the rotary die cutter or from an external source. Separate stripping dies may be provided for mating with each cutting die to facilitate fast attachment to the stripping device thereby significantly reducing set-up time. The stripping devices disclosed herein reduce the necessity for the normal precision with which rotary steel cutting dies are constructed thereby reducing the costs. Cutting will be greatly facilitated by wedging the material to be ejected in the rotary cutting die while the finished product travels through a different plane, thereby achieving a positive separation of the finished product from the material to be ejected. Lower cutting pressures will be possible with resultant longer cutting anvil life and longer cutting die life.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. In a stripping device for removing waste sheet wedged within the cutting portion of a sheet cutting die rotatable about an axis comprising: a frame; a stripping pin holder rotatably mounted on said frame and having an axis of rotation extending in the same direction and parallel to said axis of said sheet cutting die; a plurality of stripping pins mounted to said stripping pin holder and extending outwardly therefrom, said stripping pins have length and are positionable adjacent said sheet cutting die as said stripping pin holder rotates to extend into said sheet cutting die piercing said waste sheet and removing said waste sheet from said sheet cutting die upon continued rotation of said sheet cutting die and said stripping pin holder; and means operably engaged with said stripping pin holder to rotate said stripping pin holder in synchronization with said sheet cutting die; the improvement comprising: means causing the stripping pins to exert lifting action pressure against said waste sheet, including the radial distance from said stripping pin axis of rotation to the outermost extremity of each said stripping pin exceeding the radial distance from said sheet cutting die axis of rotation to said sheet cutting die cutting portions.

2. The stripping device of claim one and further comprising ejector means operable to force waste sheet away from said stripping pins once said stripping pins are rotated away from said sheet cutting die.

3. The stripping device of claim 2 wherein said stripping pin holder includes a cylindrical main body with a plurality of said stripping pin projecting externally thereof; and wherein said ejector means includes an elongated member with a free edge position next to said cylindrical main body but spaced axially from said stripping pins to pry said waste sheet from said stripping pins as said stripping pin holder rotates said stripping pins past said elongated member.

4. The stripping device of claim 3 wherein said stripping pin holder includes a shaft and a plurality of said cylindrical main bodies, axially aligned, said plurality of cylindrical main bodies mounted to said shaft and axially movable thereon.

5. The combination of: a rotary die cutter including a first drum and a second drum with parallel axes of rotation, said first drum having a sheet cutting die means mounted thereon movable past second drum, said sheet cutting die means including cutting edges separating said sheet cutting die means into a product-forming portion and a waste sheet-forming portion and operable to cut a sheet of material passing between said first drum and said second drum; a stripping pin holder rotatably mounted adjacent said first drum and having a parallel axis of rotation, said stripping pin holder having a plurality of stripping pins mounted thereto and extending therefrom into said waste sheet-forming portion of said sheet cutting die to pierce and remove waste sheet located therein; the radial distance from the farthest said stripping pin extension to said stripping pin axis of rotation exceeding the radial distance from said first drum axis of rotation to said sheet cutting die means cutting edges; and drive means operable to rotate said first drum in a direction opposite said second drum and said stripping pin holder to move said stripping pins into and out of said waste sheet-forming portion of said sheet cutting die means.

6. The combination of claim 5 and further comprising ejector means operable to remove waste sheet from said stripping pins as said stripping pin holder is rotated with said stripping pins past said ejector means.

7. The combination of claim 6 wherein said stripping pin holder includes a drive shaft with a plurality of axially shiftable hubs mounted thereto, and wherein said stripping pins are mounted to said hubs.

8. An apparatus comprising a holder and a plurality of stripping pins mounted thereto, a rotary cutting die mounted adjacent said holder, said plurality of stripping pins operable to remove waste sheet from said rotary cutting die, the rotary cutting die having steel rule cutting knives describing configurations, said stripping pins so-located on said holder to mate with configurations described by said steel rule cutting knives that said stripping pins can penetrate waste sheet in said configurations in said rotary cutting die and lift said waste sheet from said rotary cutting die as said rotary cutting die moves apart from said stripping pins in said rotation; drive means engaged with said holder and said rotary cutting die operable to rotate said holder in synchronization with said rotary cutting die, said holder including a first axis of rotation and a plurality of laterally-movable hubs upon which are mounted said stripping pins, said stripping pins having outer ends located a first distance from said first axis, said rotary cutting die including a second axis of rotation parallel to said first axis with said steel rule cutting knives located a second distance from said second axis and with said first distance being greater than said second distance, providing a greater surface speed of said outer ends as opposed to said steel rule cutting knives, forcing said waste sheet forward and away from said rotary cutting die.

* * * * *